US006724151B2

(12) United States Patent
Yoo

(10) Patent No.: US 6,724,151 B2
(45) Date of Patent: Apr. 20, 2004

(54) APPARATUS AND METHOD OF DRIVING ELECTRO LUMINESCENCE PANEL

(75) Inventor: Juhn Suk Yoo, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/178,706

(22) Filed: Jun. 25, 2002

(65) Prior Publication Data

US 2003/0085665 A1 May 8, 2003

(30) Foreign Application Priority Data

Nov. 6, 2001 (KR) ..... 2001-68871

(51) Int. Cl.[7] ..... G09G 3/30
(52) U.S. Cl. ..... 315/169.3; 345/82; 345/92
(58) Field of Search ..... 315/169.2, 169.3, 315/169.4, 169.1; 345/77, 76, 78, 204, 208, 82, 92

(56) References Cited

U.S. PATENT DOCUMENTS 6,501,466 B1 * 12/2002 Yamagishi et al. ..... 345/204
6,535,185 B2 * 3/2003 Kim et al. ..... 315/169.4
6,570,338 B2 * 5/2003 Bae ..... 315/169.3
6,580,408 B1 * 6/2003 Bae et al. ..... 345/76

* cited by examiner

*Primary Examiner*—James Clinger
*Assistant Examiner*—Ephrem Alemu
(74) *Attorney, Agent, or Firm*—McKenna Long & Aldridge LLP

(57) ABSTRACT

A driving apparatus for an electro luminescence panel that is capable of preventing deterioration of a picture quality according to the present invention includes a power supply VDD for supplying power source to the electro luminescence cell OLED, a first TFT connected between the power supply and the data line, a second TFT connected between the power supply and the electro luminescence cell OLED, a third TFT connected between the power supply and the first TFT for switching according to a signal on the gate line, a fourth TFT connected between gate electrodes of the first and second PMOS TFTs and the data line for switching according to a signal on the gate line and a path of a data signal from the data line, and a capacitor connected between the gate electrodes of the first and second PMOS TFTs and the power supply.

36 Claims, 14 Drawing Sheets

APPARATUS AND METHOD OF DRIVING ELECTRO LUMINESCENCE PANEL

This application claims the benefit of Korean Patent Application No. P2001-68871 filed on Nov. 6, 2001, which is hereby incorporated by reference for all purposes as if fully set forth herein.

BACKGROUND OF THE INVENTION

1. Field of the Invention

The present invention relates to an electro luminescence panel, and more particularly to a driving apparatus of an electro luminescence panel that is capable of preventing deterioration of a picture quality caused by the reduction of a driving electric current which occurs when a gate signal is turned off.

2. Discussion of the Related Art

Recently, there have been developed various flat panel display devices reduced in weight and bulk that are capable of eliminating disadvantages of a cathode ray tube (CRT). Such flat panel display devices include a liquid crystal display (LCD), a field emission display (FED), a plasma display panel (PDP) and an electro-luminescence (EL) display etc.

Studies for heightening a display quality of the flat panel display device and for providing the flat panel display with a large-scale screen have been actively made. The EL display among these is a self-luminescent device that emits light by itself.

The EL display excites a fluorescent material in use of carriers such as electrons, holes etc to display a picture or video image. It can be driven with a DC voltage and its response speed is fast.

An EL panel, as in FIG. 1, includes gate lines GL1 to GLm and data lines DL1 to DLn arranged crossing with each other on a glass substrate 10, and pixel elements PE arranged at each of intersections of the gate lines GL1 to GLm and the data lines DL1 to DLn.

Each pixel element PE is driven to generated light corresponding to the size of a pixel signal on the data line DL when gate signals of the gate lines GL1 to GLm are enabled.

To drive such an EL panel, a gate driver 12 is connected to the gate lines GL1 to GLm and a data driver 14 is connected to the data lines DL1 to DLn. The gate driver 12 sequentially drives the gate lines GL1 to GLm. The data driver 14 supplies the pixel signal to pixel elements PE through the data lines DL1 to DLn.

In this way, shown in FIG. 2, the pixel elements PE driven by the gate driver 12 and the data driver 14 include an electroluminescent (EL) cell, such as an organic light emitting diode OLED, connected to a ground voltage line GND and a cell driving circuit 16 for driving the EL cell OLED.

FIG. 2 is a circuit diagram illustrating the pixel element PE of FIG. 1 according to a conventional art. It is a driving circuit applied to an intersection of the gate line GL and the data line DL and consists of four thin film transistors (TFTs) T1, T2, T3 and T4.

Referring to FIG. 2, the pixel element PE includes an EL cell OLED connected to a ground voltage source GND and an EL cell driving circuit 16 connected between the EL cell OLED and the data line DL.

The EL cell driving circuit 16 includes first and second PMOS TFT T1 and T2 connected to the EL cell OLED and a supply voltage line VDD to form an electric current mirror; a third PMOS TFT T3 connected to a data line DL and a gate line GL and responding to signals on the gate line GL; a fourth PMOS TFT T4 connected to a gate electrode of the first PMOS TFT T1 and the second PMOS TFT T2, the gate line GL and the third PMOS TFT T3; and the capacitor Cst connected between the gate electrode of the first PMOS TFT T1 and the second PMOS TFT T2, and the supply voltage line VDD.

In operation, if a low input signal, as in FIG. 3, is inputted to the gate line GL, the third PMOS TFT T3 and the fourth PMOS TFT T4 are turned on. If the third PMOS TFT T3 and the fourth PMOS TFT T4 are turned on, the capacitor Cst is charged, via the third PMOS TFT T3 and the fourth PMOS TFT T4, with a video signal of a fixed size that is inputted from the data line DL to synchronize with a scanning signal.

The capacitor Cst is connected with the supply voltage VDD and the gate electrode of the first PMOS TFT T1 and the second PMOS TFT T2, and is charged with the video signal supplied from the data line DL during the low input period of the gate line GL. At this moment, a data voltage, a drain voltage and a pixel voltage in a first node all form the same electric potential, and these voltages are applied to a gate of the second PMOS TFT T2. Upon the turn-off of the gate signal, the third PMOS TFT T3 and the fourth PMOS TFT T4 are in the state of high impedance, and the capacitor Cst holds the video signal supplied from the data line DL and then charged to it for one frame period.

Due to such a holding period, it is sustained by the capacitor Cst that the video signal supplied from the data line DL is supplied to the EL cell OLED. After it having been held for one frame period, the video signal charged on the capacitor Cst is supplied to the EL cell OLED to display a video image on the display panel.

However, because the input signal is not a perfect rectangular wave upon the turn-off of the gate input signal, the output resistance of the third PMOS TFT T3 increases while it being turned off. Also, the drain voltage rises in a short time to the supply voltage. When the fourth PMOS TFT T4 is not turned off in advance, the rise of the drain voltage results in the rise of the pixel voltage. The rise of the pixel voltage drops a gate-source voltage Vgs of the second PMOS TFT T2 to decrease the brightness of the EL cell OLED. Such a change of the pixel voltage is much bigger than a kick back phenomenon caused by simply capacitive coupling. Even if the time while the gate signal changes from the turn-on state to the turn-off state is reduced or the capacitance is increased, the pixel voltage change does not decrease to a desirable level.

FIG. 5 represents a pixel structure with two gate lines according to a conventional art.

Referring to FIG. 5, a pixel element PE includes an EL cell OLED connected to a ground potential source GND, and an EL cell driving circuit 26 connected between the EL cell OLED and a data line DL.

The EL cell driving circuit 26 includes first and a second PMOS TFT T1 and T2 connected to the EL cell OLED and a supply voltage line VDD to form an electric current mirror; a third PMOS TFT T3 connected to a data line DL and a first gate line GL1 and responded to signals on the gate line GL; a fourth PMOS TFT T4 connected to a gate electrode of the first PMOS TFT T1 and the second PMOS TFT T2, a second gate line GL2 and the third PMOS TFT T3; and a capacitor Cst connected between the gate electrode of the first PMOS TFT T1 and the second PMOS TFT T2, and the supply voltage line VDD.

In operation, if a low input signal, as in FIG. 6, is inputted to the first and second gate lines GL1 and GL2 at the same time, the third PMOS TFT T3 and the fourth PMOS TFT T4 are turned on. If the third PMOS TFT T3 and the fourth PMOS TFT T4 are turned on, the capacitor Cst is charged via the third PMOS TFT T3 and the fourth PMOS TFT T4 with a video signal of a fixed size that is inputted from the data line DL to synchronize with a scanning signal. In other words, the capacitor Cst is connected with the supply voltage VDD and the gate electrode of the first PMOS TFT T1 and the second PMOS TFT T2 and is charged with the video signal supplied from the data line DL during the low input period of the first and second gate lines GL1 and GL2.

After this, by inputting a high input signal to the second gate line GL2 before the first gate line GL1, the fourth PMOS TFT T4 is made to be in a high impedance state beforehand as in FIG. 7A to have the pixel voltage sustain the data voltage. (Vdata=Vdrain=Vpixel) Then, even if the first gate line GL1 is turned off by inputting the high input signal to the first gate line GL1, and even if the drain voltage Vdrain rises to the supply voltage as in FIG. 7B, it does not have an effect on the pixel voltage Vpixel.

However, because two gate lines GL1 and GL2 should be every one pixel element in this case, the pixel element has decreased brightness because of the reduction of aperture area. There is also a problem that its cost increases because two gate driving circuit should be formed independently.

SUMMARY OF THE INVENTION

Accordingly, the present invention is directed to an apparatus and method of driving electro luminescence panel that substantially obviates one or more of the problems due to limitations and disadvantages of the related art.

An advantage of the present invention is to provide a driving apparatus of an electro luminescence panel that is capable of improving picture quality by changing the location of a fourth PMOS TFT in the electro luminescence panel with a four TFT structure.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus of an electro luminescence panel according to one aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first PMOS TFT connected between the power supply and the data line, a second PMOS TFT connected between the power supply and the electro luminescence cell OLED, a third PMOS TFT connected between the power supply and the first PMOS TFT for switching according to a signal of the gate line, a fourth PMOS TFT connected between gate electrodes of the first and the second PMOS TFT's and the data line for switching according to a signal of the gate line and a path of a data signal from the data line, and a capacitor connected between the gate electrodes of the first and the second PMOS TFT's and the power supply.

A driving apparatus of an electro luminescence panel according to another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first PMOS TFT connected between the power supply and the data line, a second PMOS TFT connected between the power supply and the electro luminescence cell OLED, a first NMOS TFT connected between the power supply and the first PMOS TFT for playing role of a switch by a signal of the gate line, a second NMOS TFT connected between gate electrodes of the first and the second PMOS TFT's and the data line for switching according to a signal of the gate line and a path of a data signal from the data line, and a capacitor connected between the gate electrodes of the first and the second PMOS TFT's and the power supply.

A driving apparatus of an electro luminescence panel according to still another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first NMOS TFT connected between the power supply and the data line, a second NMOS TFT connected between the power supply and the electro luminescence cell OLED, a first PMOS TFT connected between the power supply and the first NMOS TFT for playing role of a switch by a signal of the gate line, a second PMOS TFT connected between gate electrodes of the first and the second NMOS TFT's and the data line for playing role of a switch by a signal of the gate line and a path of a data signal from the data line, and a capacitor connected between the gate electrodes of the first and the second NMOS TFT's and the power supply.

A driving apparatus of an electro luminescence panel according to still another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first NMOS TFT connected between the power supply and the data line, a second NMOS TFT connected between the power supply and the electro luminescence cell OLED, a third NMOS TFT connected between the power supply and the first NMOS TFT for playing role of a switch by a signal of the gate line, a fourth NMOS TFT connected between gate electrodes of the first and the second NMOS TFT's and the data line for playing role of a switch by a signal of the gate line and a path of a data signal from the data line, and a capacitor connected between the gate electrodes of the first and the second NMOS TFT's and the power supply.

A driving apparatus of an electro luminescence panel according to still another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first PMOS TFT connected between the power supply and the data line, a second PMOS TFT connected between the power supply and the electro luminescence cell OLED, a third PMOS TFT connected between the power supply and a source electrode of the first PMOS TFT for being switched by a signal of the gate line, a fourth PMOS TFT connected between gate electrodes of the first and the second PMOS TFT's and the data line acting as a switch and at the same time a path of a data signal from the data line, and a capacitor connected between the gate electrodes of the first and the second PMOS TFT's and the power supply.

A driving apparatus of an electro luminescence panel according to still another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first PMOS TFT connected between the power supply and the data line, a second PMOS TFT connected between the power supply and the electro luminescence cell OLED, a first NMOS TFT connected between the power supply and a source electrode of the first PMOS TFT for being switched by a signal of the gate line, a second NMOS TFT connected between gate electrodes of the first and the second PMOS TFT's and the data line for acting as a switch and at the same time a path of a data signal from the data line, and a capacitor connected between the gate electrodes of the first and the second PMOS TFT's and the power supply.

A driving apparatus of an electro luminescence panel according to still another aspect of the present invention having gate lines, data lines arranged crossing with the gate lines, and electro luminescence cells OLED at intersections of the gate lines and the data lines, includes an electro luminescence cell OLED driving circuit at the intersections of the gate lines and the data lines for driving the electro luminescence cells; and wherein the electro luminescence cell driving circuit includes a power supply VDD for supplying power source to the electro luminescence cell OLED, a first NMOS TFT connected between the power supply and the data line, a second NMOS TFT connected between the power supply and the electro luminescence cell OLED, a first PMOS TFT connected between the power supply and a source electrode of the first NMOS TFT for being switched by a signal of the gate line, a second PMOS TFT connected between gate electrodes of the first and the second NMOS TFT's and the data line for playing role of a switch and at the same time a path of a data signal from the data line, and a capacitor connected between the gate electrodes of the first and the second NMOS TFT's and the power supply.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
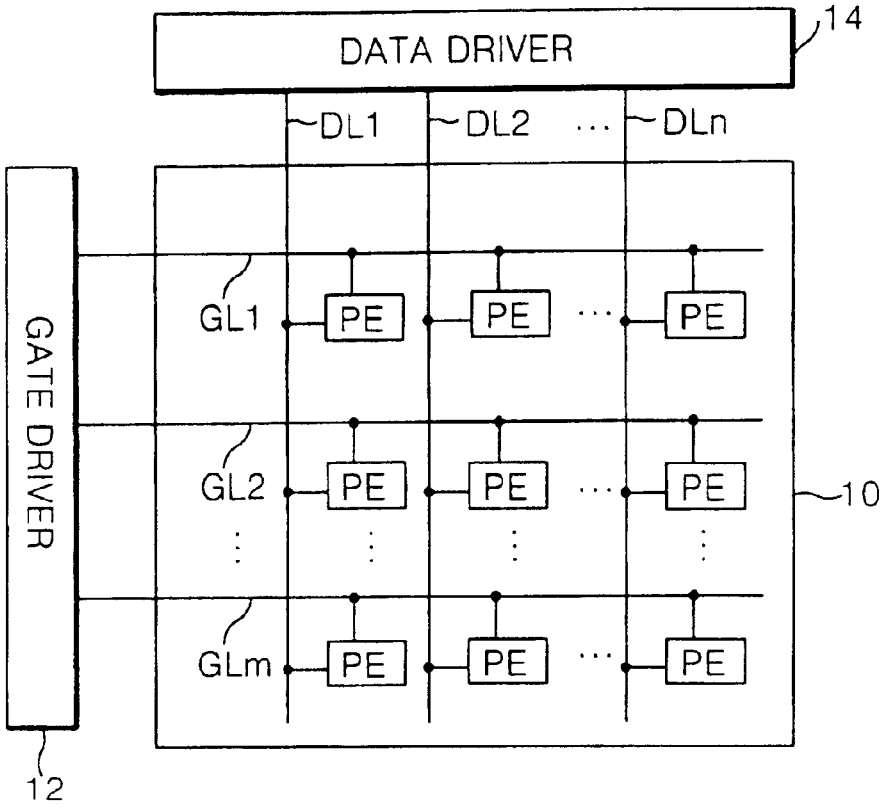
FIG. 1 CONVENTIONAL ART
FIG. 1 illustrates an electro luminescence panel according to a conventional art.
Figure 2:
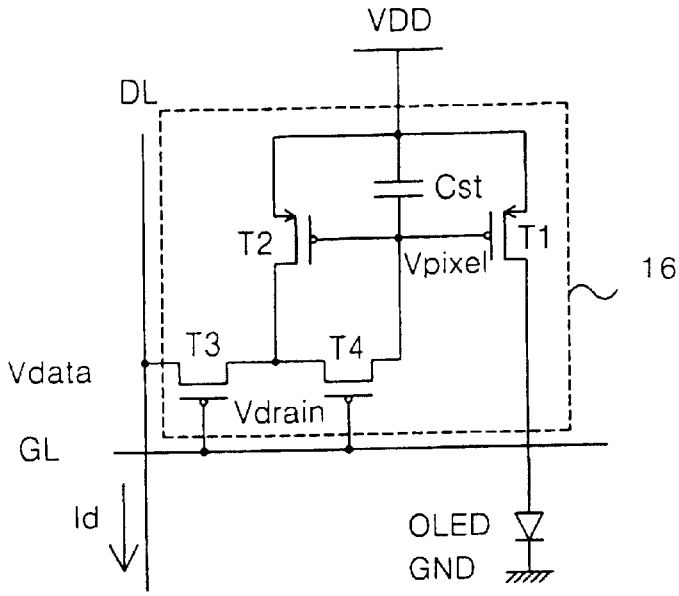
FIG.2 CONVENTIONAL ART
FIG. 2 is a circuit diagram representing a pixel element of the electroluminescence panel illustrated in FIG. 1.
Figure 3:
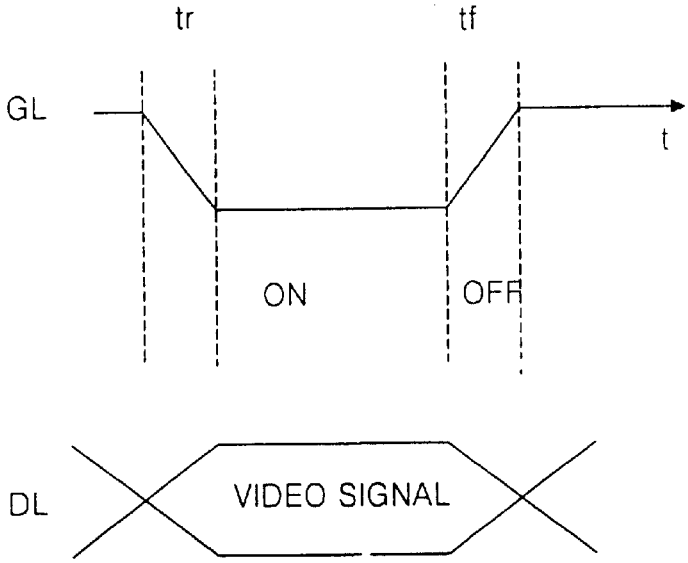
FIG.3 CONVENTIONAL ART
FIG. 3 is a timing diagram for driving the pixel element of FIG. 2.
Figure 4A:
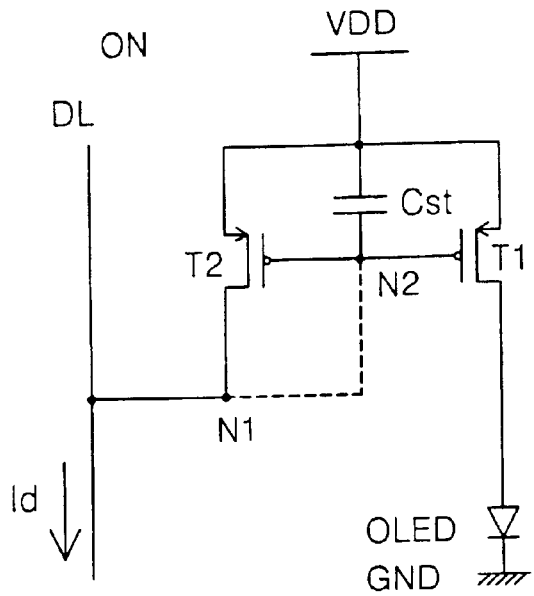
FIG.4A CONVENTIONAL ART
FIGS. 4A and 4B represent the state of the pixel element according to driving timing of FIG. 3.
Figure 4B:
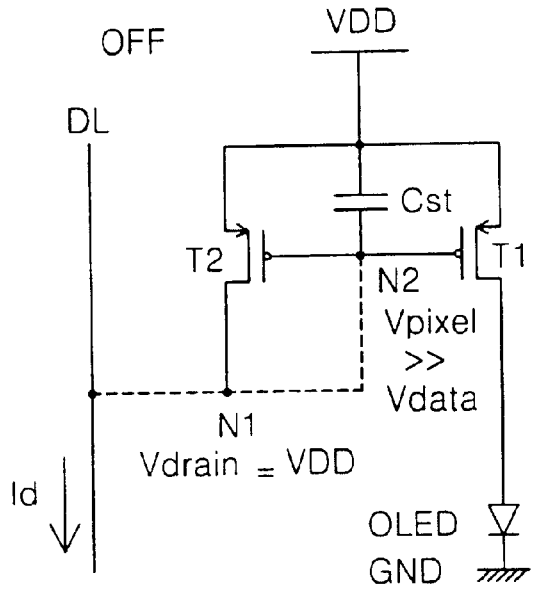
FIG.4B CONVENTIONAL ART
Figure 5:
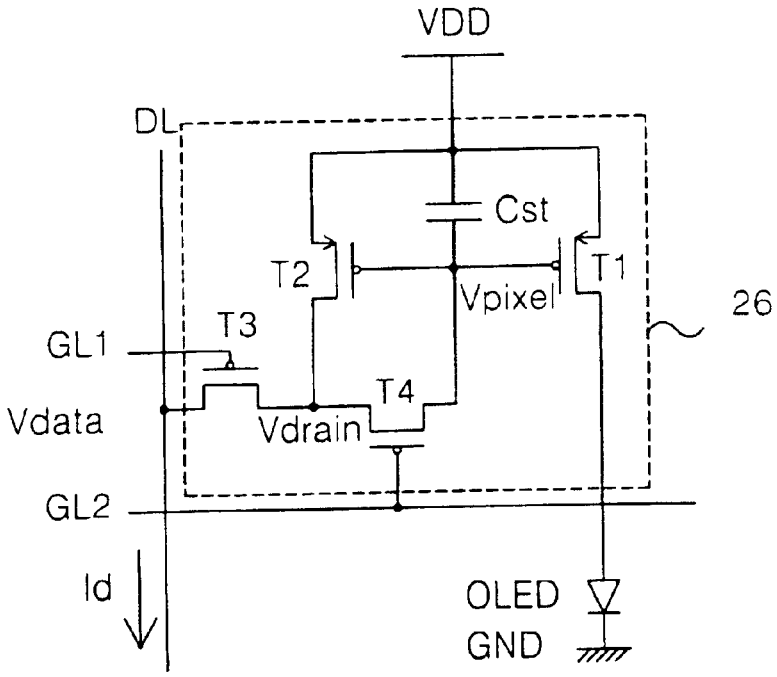
FIG.5 CONVENTIONAL ART
FIG. 5 represents a pixel structure with two gate lines according to a conventional art.
Figure 6:
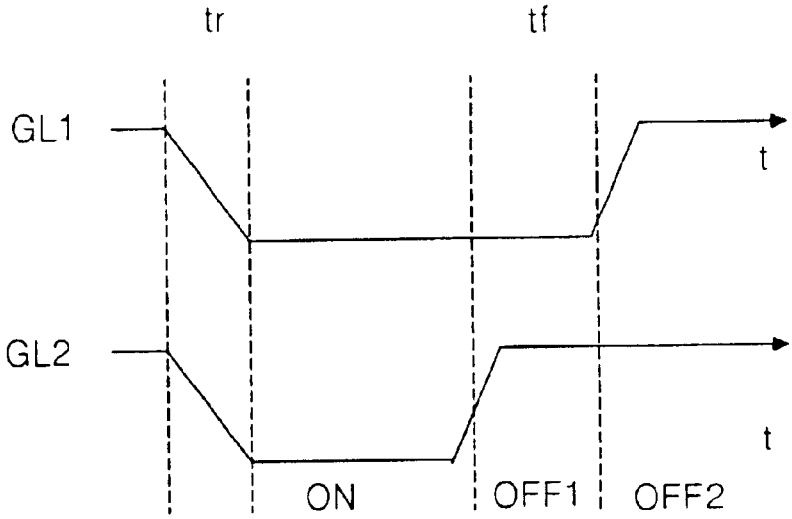
FIG.6 CONVENTIONAL ART
FIG. 6 is a timing diagram for driving the pixel element of FIG. 5.
Figure 7A:
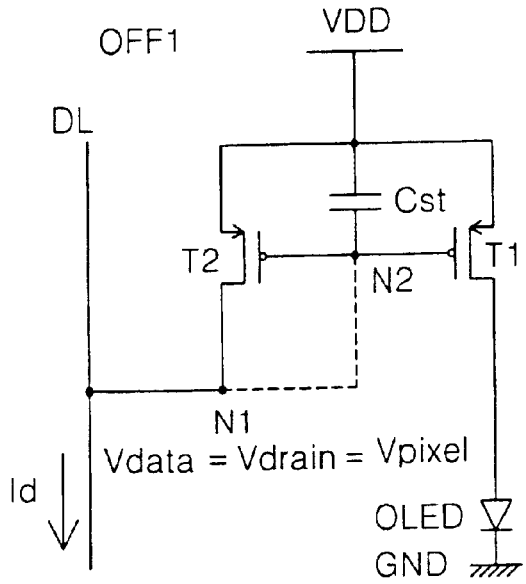
FIG. 7A CONVENTIONAL ART
FIGS. 7A and 7B represent the state of the pixel element according to driving timing of FIG. 6.
Figure 7B:
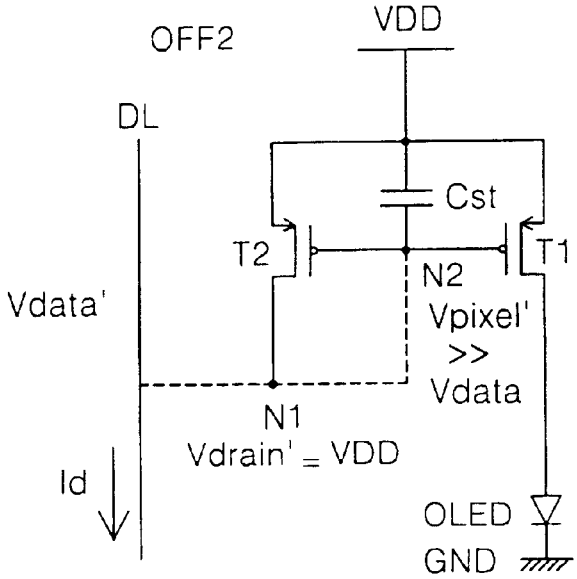
FIG. 7B CONVENTIONAL ART

In the present invention as in FIG. 1, an EL panel includes gate lines GL1 to GLm and data lines DL1 to DLn arranged crossing with each other on a glass substrate 10, and pixel elements PE arranged at each of intersections of the gate lines GL1 to GLm and the data lines DL1 to DLn.

When gate signals of the gate lines GL1 to GLm are enabled, each pixel element PE is driven to generate light corresponding to the size of a pixel signal on the data line DL.

To drive such an EL panel, a gate driver 12 is connected to the gate lines GL1 to GLm and a data driver 14 is connected to the data lines DL1 to DLn. The gate driver 12 sequentially drives the gate lines GL1 to GLm. The data driver 14 supplies the pixel signal to pixel elements PE through the data lines DL1 to DLn.

Figure 8:
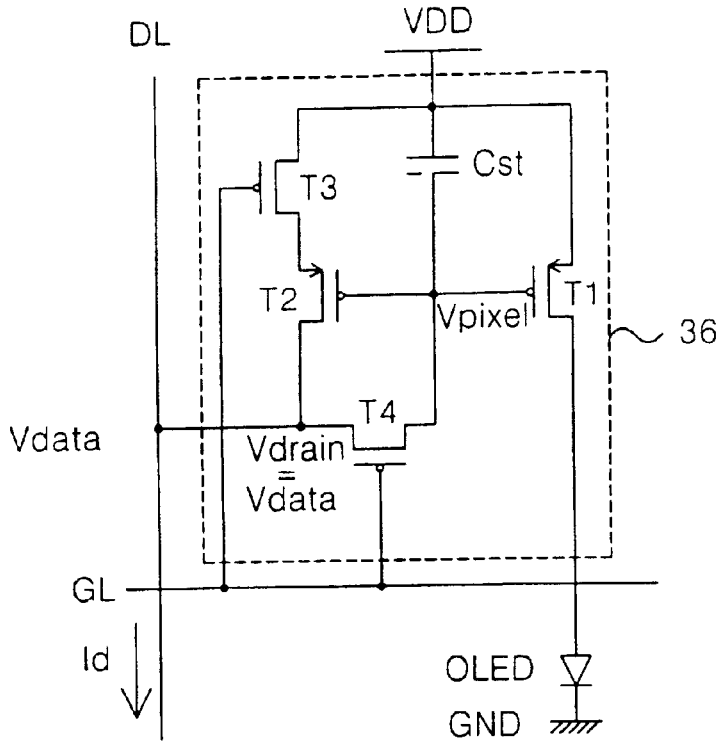
FIG. 8 represents a pixel element of an electro luminescence panel according to a first embodiment of the present invention.

FIG. 8 represents a pixel element of an electro luminescence panel according to the first embodiment of the present invention. The pixel elements PE include an electroluminescent (EL) cell, such as an organic light emitting diode OLED, connected to a ground voltage source GND and a cell driving circuit 36 for driving the EL cell OLED.

The EL cell driving circuit 36 includes first and second PMOS TFTs T1 and T2 connected to the EL cell OLED and a supply voltage line VDD to form an electric current mirror; a third PMOS TFT T3 connected between the supply voltage line VDD and a source electrode of the second PMOS TFT T2 and responsive to signals on the gate line GL; a fourth PMOS TFT T4 connected between the data line DL and a gate electrode of the first and second PMOS TFT's T1 and T2, and responsive to signals on the gate line GL and the data line DL; and a capacitor Cst connected between the gate electrode of the first PMOS TFT T1 and the second PMOS TFT T2, and the supply voltage line VDD.

Figure 9:
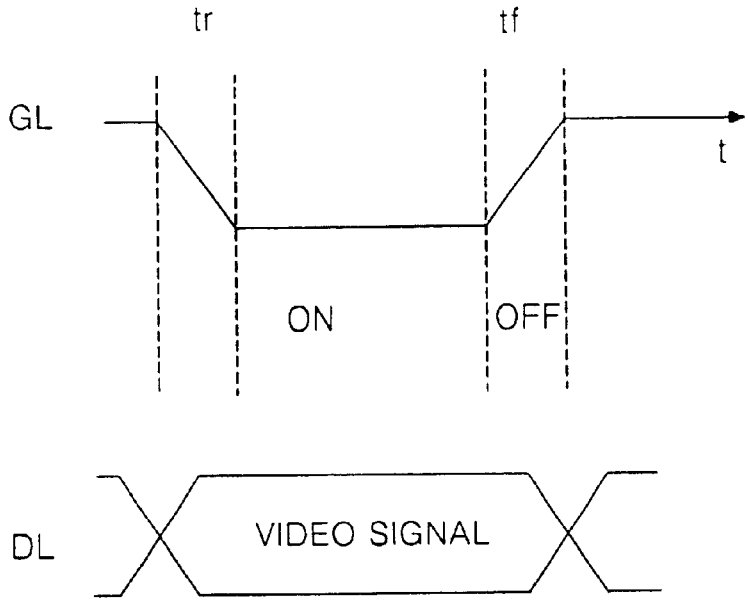
FIG. 9 is a timing diagram for driving the pixel element of FIG. 8.

In operation, if a low input signal, as in FIG. 9, is inputted to the gate line GL, the third PMOS TFT T3 and the fourth PMOS TFT T4 are turned on. If the third PMOS TFT T3 and the fourth PMOS TFT T4 are turned on, the capacitor Cst is charged, via the fourth PMOS TFT T4, with a video signal of a fixed size that is inputted from the data line DL to synchronize with a scanning signal.

Figure 10A:
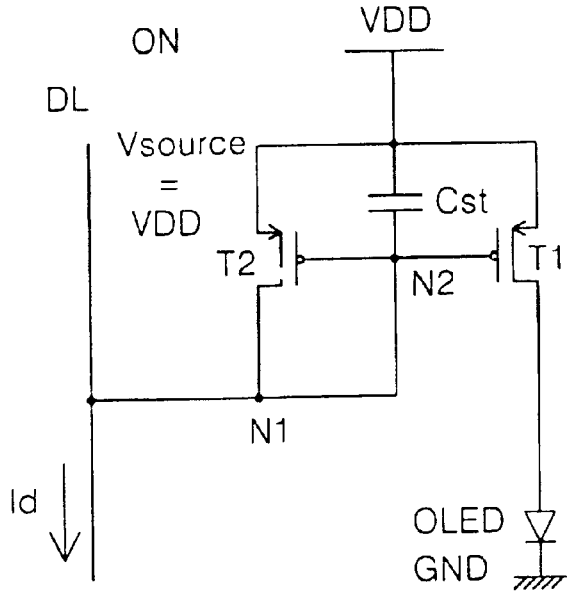
FIGS. 10A and 10B represent the state of the pixel element according to driving timing of FIG. 8.

In this case, a data voltage Vdrain, a drain voltage Vdrain and a pixel voltage Vpixel in the first node N1 sustain the same voltage level as in FIG. 10A. Also, a source voltage of the second PMOS TFT T2 remains at the same voltage level as the supply voltage. Thus, the third PMOS TFT T3 switches the electric current from the data line DL to a pixel electrode and in addition acts as a switch between the supply voltage line VDD and a source of the second PMOS TFT T2.

Figure 10B:
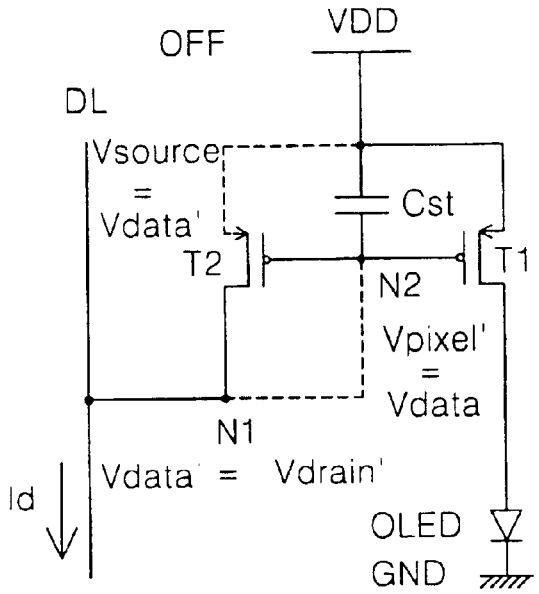

Then, if the input signal of the gate line GL is turned off, as in FIG. 10B, the third PMOS TFT T3 shuts off the supply voltage from the supply voltage line VDD at the source of the second PMOS TFT T2 to control a phenomenon that the drain voltage of the second PMOS TFT T2 is pulled up to the supply voltage. Because the fourth PMOS TFT T4 is turned off in the state when the data voltage remains constant, the gate voltage of the first PMOS TFT T1 is stably sampled to prevent the picture quality from deteriorating.

Moreover, upon the turn-off of the gate signal, the third PMOS TFT T3 and the fourth PMOS TFT T4 become in the state of high impedance, and the capacitor Cst holds the video signal supplied from the data line DL and is charged with it for one frame period. Due to such a holding period, the video signal is sustained by the capacitor Cst such that it continues to be supplied to the EL cell OLED. After being held for one frame period, the video signal is charged to the capacitor Cst with is supplied to the EL cell OLED to display a video image on the display panel.

Figure 11:
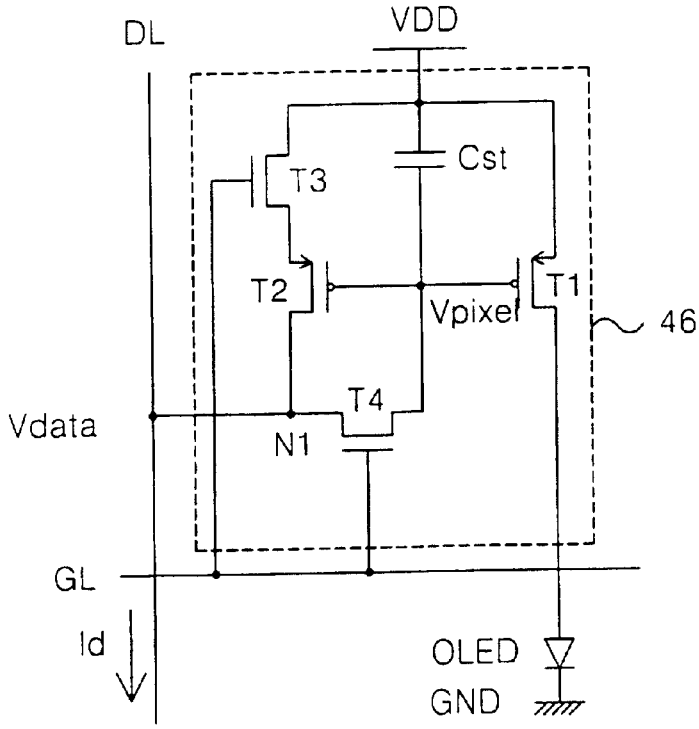
FIG. 11 represents a pixel element of an electro luminescence panel according to a second embodiment of the present invention.

FIG. 11 represents a pixel element of an electro luminescence panel according to the second embodiment of the present invention. The pixel elements PE include an EL cell OLED connected to a ground voltage source GND and a cell driving circuit 46 for driving the EL cell OLED.

The EL cell driving circuit 46 includes the first and second PMOS TFTs T1 and T2 connected to the EL cell OLED and a supply voltage line VDD to form an electric current mirror; a first NMOS TFT T3 connected between the supply voltage line VDD and a source electrode of the second PMOS TFT T2 and responsive to signals on the gate line GL; a second NMOS TFT T4 connected between the data line DL and a gate electrode of the first and second PMOS TFTs T1 and T2, and responsive to signals on the gate line GL and the data line DL; and a capacitor Cst connected between the gate electrode of the first PMOS TFT T1 and the second PMOS TFT T2, and the supply voltage line VDD.

Figure 12:
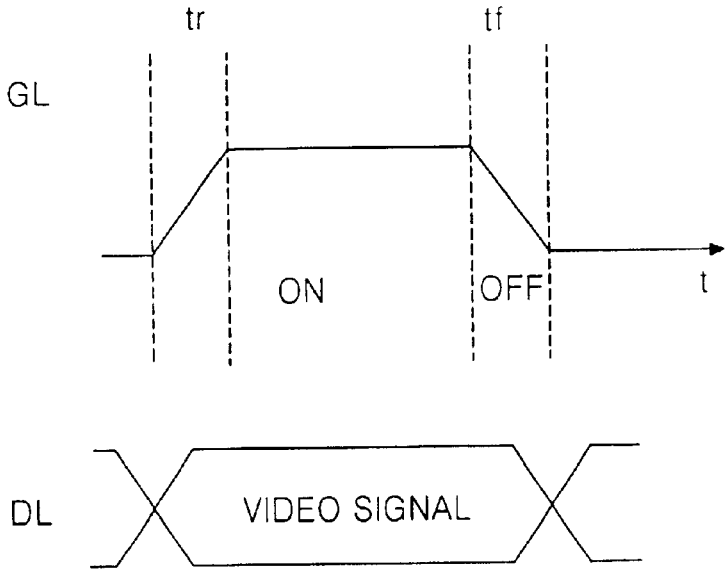
FIG. 12 is a timing diagram for driving the pixel element of FIG. 11.

In operation, if a high input signal, as in FIG. 12, is inputted to the gate line GL, the first NMOS TFT T3 and the second NMOS TFT T4 are turned on. If the first NMOS TFT T3 and the second NMOS TFT T4 are turned on, the capacitor Cst is charged, via the second NMOS TFT T4, with a video signal of a fixed size that is inputted from the data line DL to synchronize with a scanning signal.

In this case, a data voltage Vdata, a drain voltage Vdrain and a pixel voltage Vpixel in the first node N1 sustain the same voltage level. Also, a source voltage of the second PMOS TFT T2 remains at the same voltage level as the supply voltage. Thus, the first NMOS TFT T3 plays role switches the electric current from the data line DL to a pixel electrode and in addition acts as a switch between the supply voltage line VDD and a source of the second PMOS TFT T2.

Then, if the input signal of the gate line GL is turned off, the first NMOS TFT T3 shuts off the supply voltage from the supply voltage line VDD at the source of the second PMOS TFT T2 to control a phenomenon that the drain voltage of the second PMOS TFT T2 is pulled up to the supply voltage. Because the second NMOS TFT T4 is turned off in the state when the data voltage remains fixed, the gate voltage of the first PMOS TFT T1 is stably sampled to prevent the picture quality from deteriorating.

Moreover, upon the turn-off of the gate signal, the first NMOS TFT T3 and the second NMOS TFT T4 become in the state of high impedance, and the capacitor Cst holds the video signal supplied from the data line DL and is charge with the video signal for one frame period. Due to such a holding period, video signal is sustained by the capacitor Cst such that it is supplied to the EL cell OLED. After it having been held for one frame period, the video signal charged to the capacitor Cst is supplied to the EL cell OLED to display a video image on the display panel.

Figure 13:
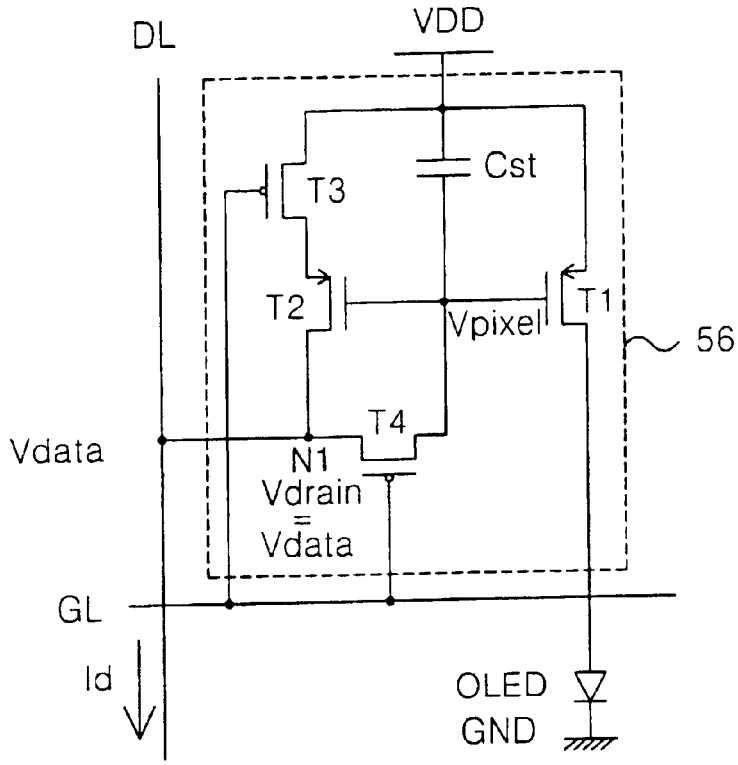
FIG. 13 represents a pixel element of an electro luminescence panel according to a third embodiment of the present invention.

FIG. 13 represents a pixel element of an electro luminescence panel according to the third embodiment of the present invention. The pixel elements PE include an EL cell OLED connected to a ground voltage source GND and a cell driving circuit 56 for driving the EL cell OLED.

The EL cell driving circuit 56 includes the first and second NMOS TFT T1 and T2 connected to the EL cell OLED and a supply voltage line VDD to form an electric current mirror; a first PMOS TFT T3 connected between the supply voltage line VDD and a source electrode of the second NMOS TFT T2 and responsive to signals on the gate line GL; a second PMOS TFT T4 connected between the data line DL and a gate electrode of the first and second NMOS TFTs T1 and T2, and responsive to signals on the gate line GL and the data line DL; and a capacitor Cst connected between the gate electrode of the first NMOS TFT T1 and the second NMOS TFT T2, and the supply voltage line VDD.

Figure 14:
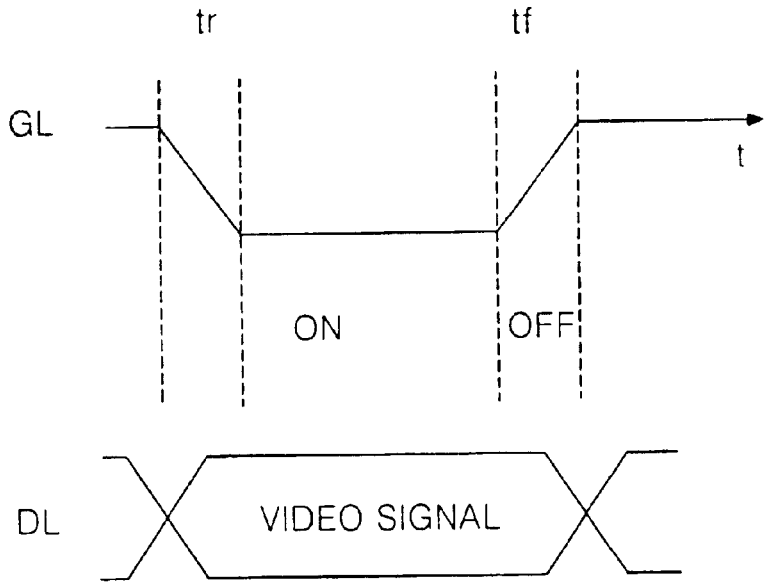
FIG. 14 is a timing diagram for driving the pixel element of FIG. 13.

In operation, if a low input signal, as in FIG. 14, is inputted to the gate line GL, the first PMOS TFT T3 and the second PMOS TFT T4 are turned on. If the first PMOS TFT T3 and the second PMOS TFT T4 are turned on, the capacitor Cst is charged, via the second PMOS TFT T4, with a video signal of a fixed size that is inputted from the data line DL to synchronize with a scanning signal.

In this case, a data voltage Vdrain, a drain voltage Vdrain and a pixel voltage Vpixel in a first node N1 sustain the same voltage level. Also, a source voltage of the second NMOS TFT T2 remains at the same voltage level as the supply voltage. Thus, the first PMOS TFT T3 switches the electric current from the data line DL to a pixel electrode and in addition acts as a switch between the supply voltage line VDD and a source of the second NMOS TFT T2.

Then, if the input signal of the gate line GL is turned off, the first PMOS TFT T3 shuts off the supply voltage from the supply voltage line VDD at the source of the second NMOS TFT T2 to control a phenomenon that the drain voltage of the second NMOS TFT T2 is pulled up to the supply voltage. Because the second PMOS TFT T4 is turned off in the state when the data voltage remains fixed, the gate voltage of the first NMOS TFT T1 is stably sampled to prevent the picture quality from deteriorating.

Moreover, upon the turn-off of the gate signal, the first PMOS TFT T3 and the second PMOS TFT T4 become in the state of high impedance, and the capacitor Cst holds the video signal supplied from the data line DL and is charged with the video signal for one frame period. Due to such a holding period, it is sustained by the capacitor Cst such that the video signal supplied from the data line DL is supplied to the EL cell OLED. After it having been held for one frame period, the video signal charged to the capacitor Cst is supplied to the EL cell OLED to display a video image on the display panel.

Figure 15:
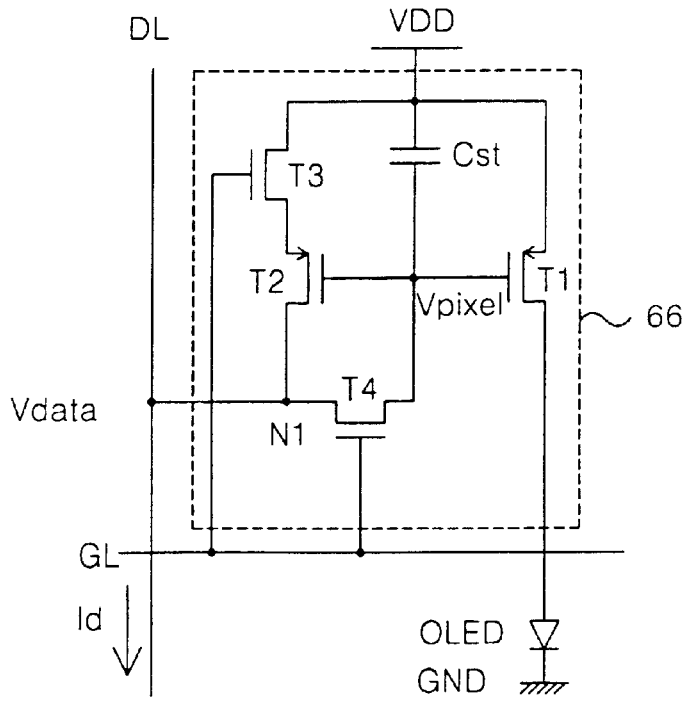
FIG. 15 represents a pixel element of an electro luminescence panel according to a fourth embodiment of the present invention.

FIG. 15 represent a pixel element of an electro luminescence panel according to the fourth embodiment of the present invention. The pixel elements PE include an EL cell OLED connected to a ground voltage source GND and a cell driving circuit 66 for driving the EL cell OLED.

The EL cell driving circuit 66 includes the first and second NMOS TFT T1 and T2 connected to the EL cell OLED and a supply voltage line VDD to form an electric current mirror; a third NMOS TFT T3 connected between the supply voltage line VDD and a source electrode of the second NMOS TFT T2 and responsive to signals on the gate line GL; a fourth NMOS TFT T4 connected between the data line DL and a gate electrode of the first and second NMOS TFTs T1 and T2, and responsive to signals on the gate line GL and the data line DL; and a capacitor Cst connected between the gate electrode of the first NMOS TFT T1 and the second NMOS TFT T2, and the supply voltage line VDD.

Figure 16:
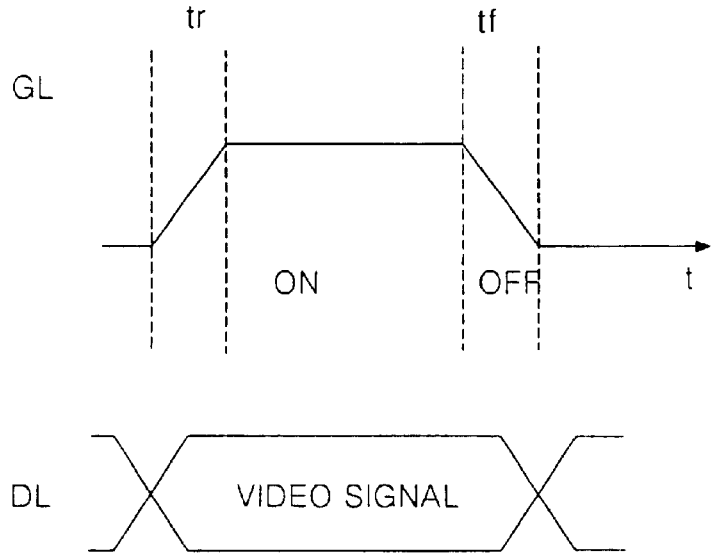
FIG. 16 is a timing diagram for driving the pixel element of FIG. 15.

In operation, if a high input signal, as in FIG. 16, is inputted to the gate line GL, the third NMOS TFT T3 and the fourth NMOS TFT T4 are turned on. If the third NMOS TFT T3 and the fourth NMOS TFT T4 are turned on, the capacitor Cst is charged, via the fourth NMOS TFT T4, with a video signal of a fixed size that is inputted from the data line DL to synchronize with a scanning signal.

In this case, a data voltage Vdrain, a drain voltage Vdrain and a pixel voltage Vpixel in the first node N1 sustain the same voltage level. Also, a source voltage of the second NMOS TFT T2 remains at the same voltage level as the supply voltage. Thus, the third NMOS TFT T3 switches the electric current from the data line DL to a pixel electrode and in addition acts as a switch between the supply voltage line VDD and a source of the second NMOS TFT T2.

Then, if the input signal of the gate line GL is turned off, the third NMOS TFT T3 shuts off the supply voltage from the supply voltage line VDD at the source of the second NMOS TFT T2 to control a phenomenon that the drain voltage of the second NMOS TFT T2 is pulled up to the supply voltage. Because the fourth NMOS TFT T4 is turned off in the state when the data voltage remains constant, the gate voltage of the first NMOS TFT T1 is stably sampled to prevent the picture quality from deteriorating.

Moreover, upon the turn-off of the gate signal, the third NMOS TFT T3 and the fourth NMOS TFT T4 become in the state of high impedance, and the capacitor Cst holds the video signal supplied from the data line DL and is charged with the video signal for one frame period. Due to such a holding period, the video signal is sustained by the capacitor Cst such that the video signal supplied from the data line DL is supplied to the EL cell OLED. After it having been held for one frame period, the video signal charged to the capacitor Cst is supplied to the EL cell OLED to display a video image on the display panel.

Figure 17:
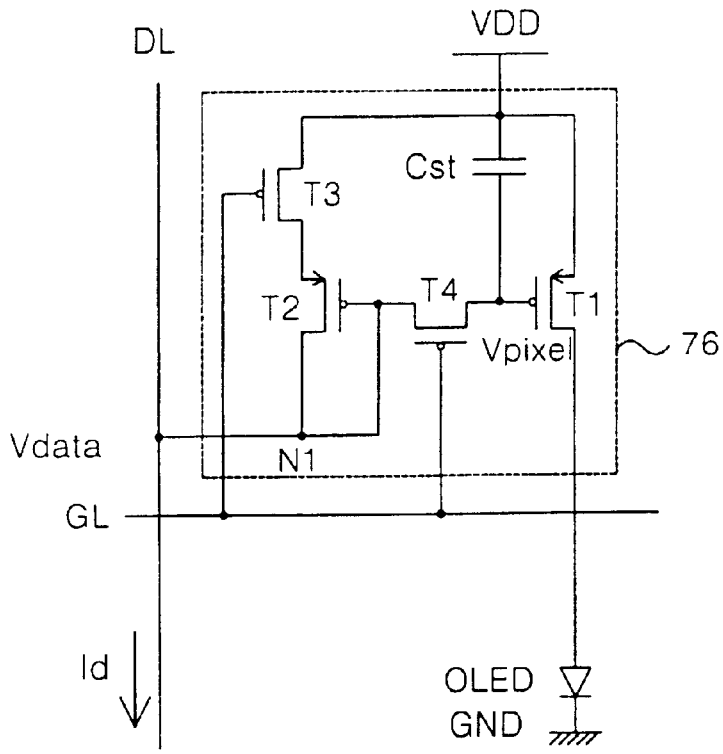
FIG. 17 represents a pixel element of an electro luminescence panel according to a fifth embodiment of the present invention.

FIG. 17 represents a pixel element of an electro luminescence panel according to the fifth embodiment of the present invention, and the pixel elements PE include an EL cell OLED connected to a ground voltage source GND and a cell driving circuit 76 for driving the EL cell OLED.

The EL cell driving circuit 76 includes the first and second PMOS TFTs T1 and T2 connected to the EL cell OLED and a supply voltage line VDD to form an electric current mirror; a third PMOS TFT T3 connected between the supply voltage line VDD and a source electrode of the second PMOS TFT T2 and responsive to signals on the gate line GL; a fourth PMOS TFT T4 connected between the first PMOS TFT T1 and the second PMOS TFT T2, and responsive to signals on the gate line GL and the data line DL; and a capacitor Cst connected between the gate electrode of the first PMOS TFT T1 and the drain electrode of the fourth PMOS TFT T4, and the supply voltage line VDD. Also, the data line DL is connected to the drain electrode of the second PMOS TFT T2 and the source electrode of the fourth PMOS TFT T4.

Figure 18:
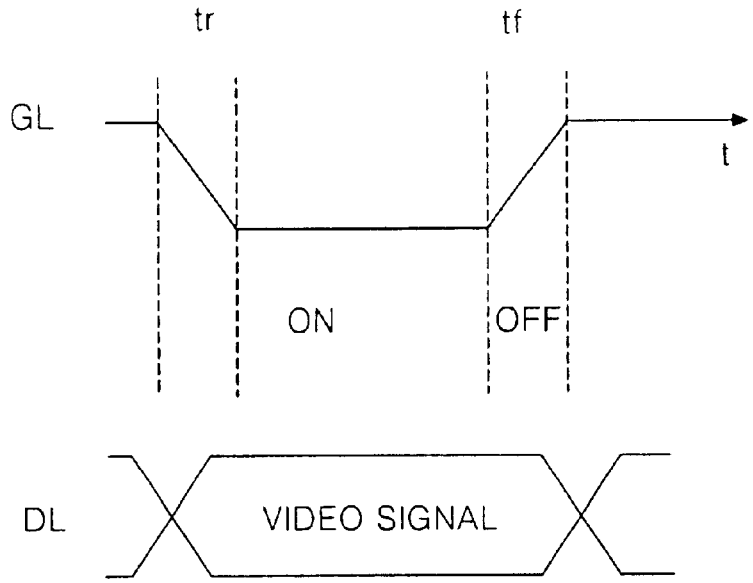
FIG. 18 is a timing diagram for driving the pixel element of FIG. 17.

In operation, if a low input signal, as in FIG. 18, is inputted to the gate line GL, the third PMOS TFT T3 and the fourth PMOS TFT T4 are turned on. If the third PMOS TFT T3 and the fourth PMOS TFT T4 are turned on, the capacitor Cst is charged, via the fourth PMOS TFT T4, with a video signal of a fixed size that is inputted from the data line DL to synchronize with a scanning signal.

In this case, a data voltage Vdrain and a pixel voltage Vpixel in the first node N1 sustain the same voltage level. Also, a source voltage of the second PMOS TFT T2 remains at the same voltage level as the supply voltage. Thus, the third PMOS TFT T3 switches the electric current from the data line DL to a pixel electrode and in addition acts as a switch between the supply voltage line VDD and a source of the second PMOS TFT T2.

Then, if the input signal of the gate line GL is turned off, the third PMOS TFT T3 shuts off the supply voltage from the supply voltage line VDD at the source of the second PMOS TFT T2 to control a phenomenon that the data voltage Vdata in the second PMOS TFT T2 is pulled up to the supply voltage. Because the fourth PMOS TFT T4 is turned off in the state when the data voltage remains constant, the gate voltage of the first PMOS TFT T1 is stably sampled to prevent the picture quality from being deteriorating. After it having been held for one frame period, the video signal charged to the capacitor Cst is supplied to the EL cell OLED to display a video image on the display panel.

Figure 19:
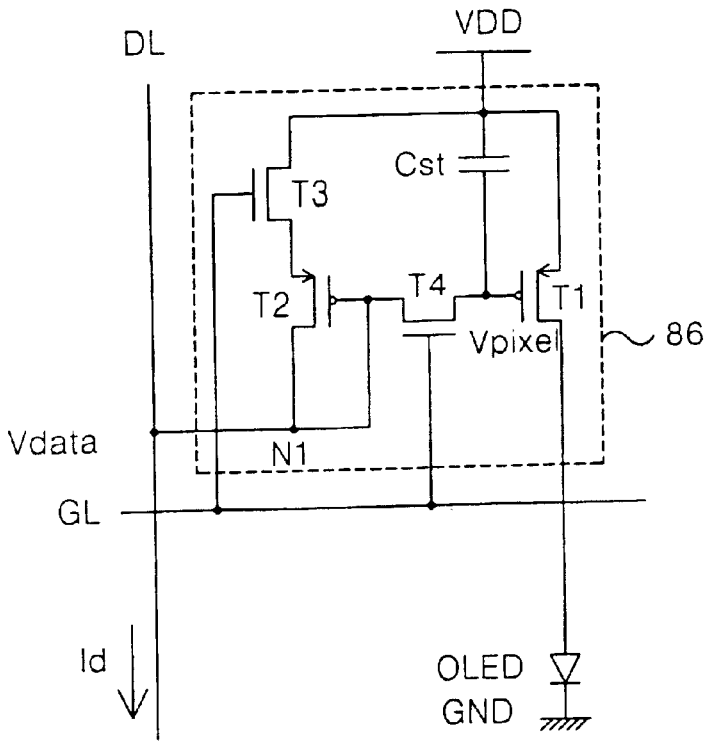
FIG. 19 represents a pixel element of an electro luminescence panel according to a sixth embodiment of the present invention.

FIG. 19 represent a pixel element of an electro luminescence panel according to a sixth embodiment of the present invention. The pixel elements PE include an EL cell OLED connected to a ground voltage source GND and a cell driving circuit 86 for driving the EL cell OLED.

The EL cell driving circuit 86 includes a first and a second PMOS TFTs T1 and T2 connected to the EL cell OLED and a supply voltage line VDD to form an electric current mirror; a first NMOS TFT T3 connected between the supply voltage line VDD and a source electrode of the second PMOS TFT T2 and responsive to signals on the gate line GL; a second NMOS TFT T4 connected between the first PMOS TFT T1 and the second PMOS TFT T2, and responsive to signals on the gate lien GL and the data line DL; and a capacitor Cst connected between the gate electrode of the first PMOS TFT T1 and the drain electrode of the second NMOS TFT T4, and the supply voltage line VDD. Also, the data line DL is connected to the drain electrode of the second PMOS TFT T2 and the source electrode of the second NMOS TFT T4.

Figure 20:
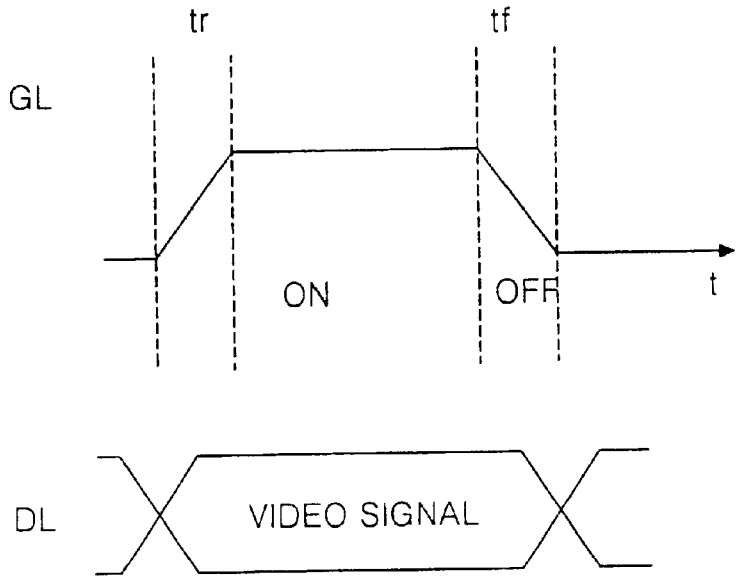
FIG. 20 is a timing diagram for driving the pixel element of FIG. 19.

In operation, if a high input signal, as in FIG. 20, is inputted to the gate line GL, the first NMOS TFT T3 and the second NMOS TFT T4 are turned on. If the first NMOS TFT T3 and the second NMOS TFT T4 are turned on, the capacitor Cst is charged, via the second NMOS TFT T4, with a video signal of a fixed size that is inputted from the data line DL to synchronize with a scanning signal.

In this case, a data voltage Vdrain and a pixel voltage Vpixel in the first node N1 sustain the same voltage level. Also, a source voltage of the second PMOS TFT T2 remains at the same voltage level as the supply voltage. Thus, the first NMOS TFT T3 switches the electric current from the data line DL to a pixel electrode and in addition acts as a switch between the supply voltage line VDD and a source of the second PMOS TFT T2.

Then, if the input signal of the gate line GL is turned off, the first NMOS TFT T3 shuts off the supply voltage from the supply voltage line VDD at the source of the second PMOS TFT T2 to control a phenomenon that the data voltage Vdata in the second PMOS TFT T2 is pulled up to the supply voltage. Because the second NMOS TFT T4 is turned off in the state when the data voltage remains constant, the gate voltage of the first PMOS TFT T1 is stably sampled to prevent the picture quality from deteriorating.

Moreover, upon the turn-off of the gate signal, the first NMOS TFT T3 and the second NMOS TFT T4 become in the state of high impedance, and the capacitor Cst holds the video signal supplied from the data line DL and is charged with it for one frame period. Due to such a holding period, the video signal is sustained by the capacitor Cst such that the video signal supplied from the data line DL is supplied to the EL cell OLED. After having been held for one frame period, the video signal charged to the capacitor Cst is supplied to the EL cell OLED to display a video image on the display panel.

Figure 21:
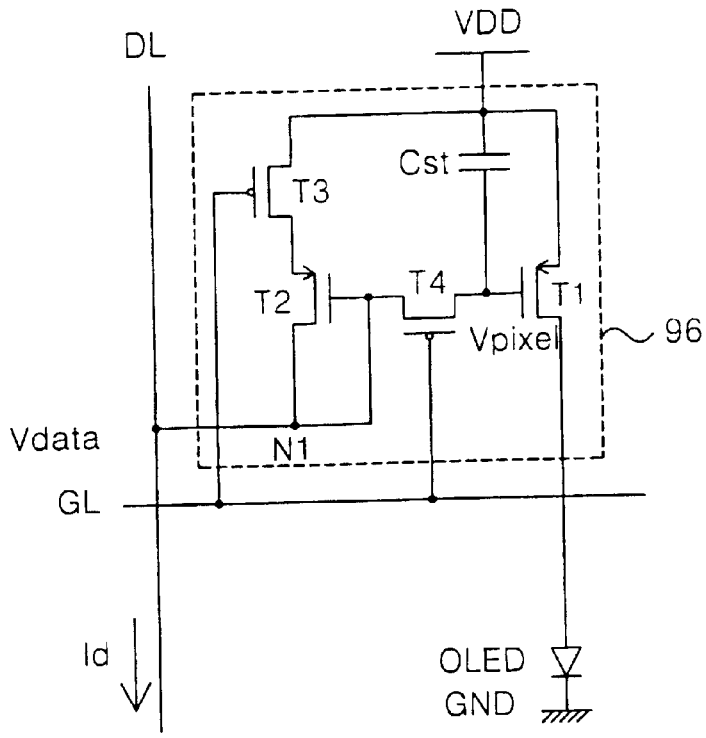
FIG. 21 represents a pixel element of an electro luminescence panel according to a seventh embodiment of the present invention.

FIG. 21 particularly represents a pixel element of an electro luminescence panel according to the seventh embodiment of the present invention. The pixel elements PE include an EL cell OLED connected to a ground voltage source GND and a cell driving circuit 96 for driving the EL cell OLED.

The EL cell driving circuit 96 includes the first and second NMOS TFTs T1 and T2 connected to the EL cell OLED and a supply voltage line VDD to form an electric current mirror; a first PMOS TFT T3 connected between the supply voltage line VDD and a source electrode of the second NMOS TFT T2 and responsive to signals on the gate line GL; a second PMOS TFT T4 connected between the first NMOS TFT T1 and the second NMOS TFT T2, and responsive to signals on the gate line GL and the data line DL; and a capacitor Cst connected between the gate electrode of the first NMOS TFT T1 and the drain electrode of the second PMOS TFT T4, and the supply voltage line VDD. Also, the data line DL is connected to the drain electrode of the second NMOS TFT T2 and the source electrode of the second PMOS TFT T4.

Figure 22:
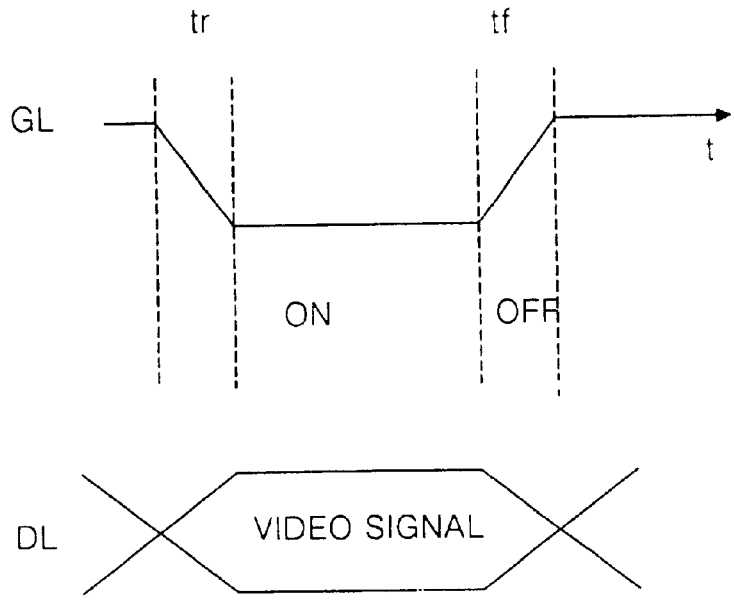
FIG. 22 is a timing diagram for driving the pixel element of FIG. 21.

In operation, if a low input signal, as in FIG. 22, is inputted to the gate line GL, the first PMOS TFT T3 and the second PMOS TFT T4 are turned on. If the first PMOS TFT T3 and the second PMOS TFT T4 are turned on, the capacitor Cst is charged, via the second PMOS TFT T4, with a video signal of a fixed size that is inputted from the data line DL to synchronize with a scanning signal.

In this case, a data voltage Vdrain and a pixel voltage Vpixel in the first node N1 sustain the same voltage level. Also, a source voltage of the second NMOS TFT T2 remains at the same voltage level as the supply voltage. Thus, the first PMOS TFT T3 switches the electric current from the data line DL to a pixel electrode and in addition acts as a switch between the supply voltage line VDD and a source of the second NMOS TFT T2.

Then, if the input signal of the gate line GL is turned off, the first PMOS TFT T3 shuts off the supply voltage from the supply voltage line VDD at the source of the second NMOS TFT T2 to control a phenomenon that the data voltage Vdata in the second NMOS TFT T2 is pulled up to the supply voltage. Because the second PMOS TFT T4 is turned off in the state when the data voltage remains fixed, the gate voltage of the first NMOS TFT T1 is stably sampled to prevent the picture quality from being deteriorated.

Moreover, upon the turn-off of the gate signal, the first PMOS TFT T3 and the second PMOS TFT T4 become in the state of high impedance, and the capacitor Cst holds the video signal supplied from the data line DL and is charged with it for one frame period. Due to such a holding period, the video signal is sustained by the capacitor Cst such that the video signal supplied from the data line DL is supplied to the EL cell OLED. After having been held for one frame period, the video signal charged the capacitor Cst with is supplied to the EL cell OLED to display a video image on the display panel.

Figure 23:
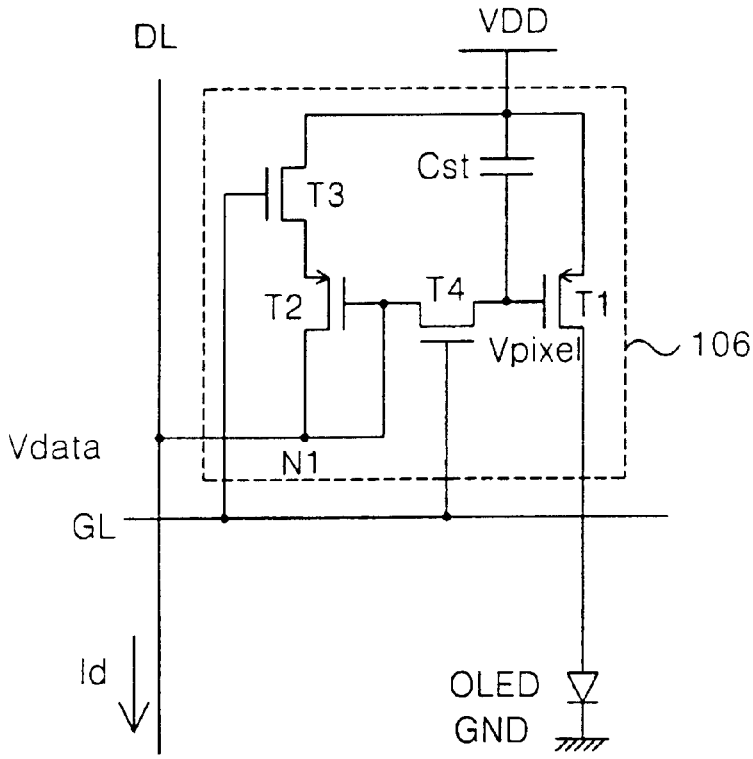
FIG. 23 represents a pixel element of an electro luminescence panel according to a eighth embodiment of the present invention.

FIG. 23 represent a pixel element of an electro luminescence panel according to the eighth embodiment of the present invention. The pixel elements PE include an EL cell OLED connected to a ground voltage source GND and a cell driving circuit 106 for driving the EL cell OLED.

The EL cell driving circuit 106 includes first and second NMOS TFT T1 and T2 connected to the EL cell OLED and a supply voltage line VDD to form an electric current mirror; a third NMOS TFT T3 connected between the supply voltage line VDD and a source electrode of the second NMOS TFT T2 and responsive to signals on the gate line GL; the fourth NMOS TFT T4 connected between the first NMOS TFT T1 and the second NMOS TFT T2, and responsive to signals on the gate line GL and the data line DL; and a capacitor Cst connected between the gate electrode of the first NMOS TFT T1 and the drain electrode of the fourth NMOS TFT T4, and the supply voltage line VDD. Also, the data line DL is connected to the drain electrode of the second NMOS TFT T2 and the source electrode of the fourth NMOS TFT T4.

Figure 24:
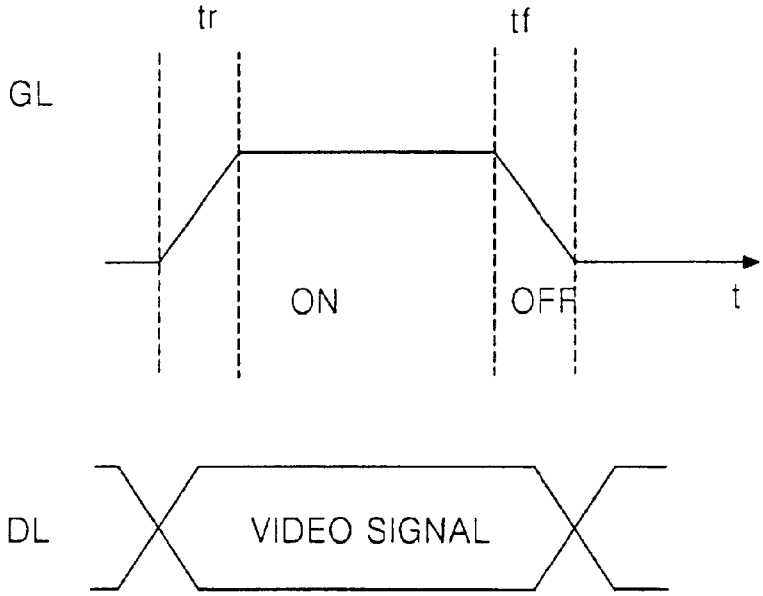
FIG. 24 is a timing diagram for driving the pixel element of FIG. 23.

In operation, if a high input signal, as in FIG. 24, is inputted to the gate line GL, the third NMOS TFT T3 and the fourth NMOS TFT T4 are turned on. If the third NMOS TFT T3 and the fourth NMOS TFT T4 are turned on, the capacitor Cst is charged, via the fourth NMOS TFT T4, with a video signal of a fixed size that is inputted from the data line DL to synchronize with a scanning signal.

In this case, a data voltage Vdrain and a pixel voltage Vpixel in a first node N1 sustain the same voltage level. Also, a source voltage of the second NMOS TFT T2 remains at the same voltage level as the supply voltage. Thus, the third NMOS TFT T3 switches the electric current from the data line DL to a pixel electrode and in addition acts as a switch between the supply voltage line VDD and a source of the second NMOS TFT T2.

Then, if the input signal of the gate line GL is turned off, the third NMOS TFT T3 shuts off the supply voltage from the supply voltage line VDD at the source of the second NMOS TFT T2 to control a phenomenon that the data voltage Vdata in the second NMOS TFT T2 is pulled up to the supply voltage. Because the fourth NMOS TFT T4 is turned off in the state when the data voltage remains fixed, the gate voltage of the first NMOS TFT T1 is stably sampled to prevent the picture quality from deteriorating.

Moreover, upon the turn-off of the gate signal, the third NMOS TFT T3 and the fourth NMOS TFT T4 become in the state of high impedance, and the capacitor Cst holds the video signal supplied from the data line DL and is charged with it for one frame period. Due to such a holding period, the video signal is sustained by the capacitor Cst such that the video signal supplied from the data line DL is supplied to the EL cell OLED. After having been held for one frame period, the video signal charged to the capacitor Cst is supplied to the EL cell OLED to display a video image on the display panel.

Depending on the types of transistors used in the driving circuit of the present invention, the signal on the gate line may range from −4V to −10V or +4V to +10V. Other values are also possible depending on the actual components used in the driving circuit.

As described above, the driving apparatus of the electro luminescence panel and method thereof according to the present invention changes the constituent location of one transistor between two switching thin film transistors in a electro luminescence panel with one gate line structure, thereby restraining a reference voltage change upon turning off the input signal of the gate line and shutting off the change of the driving electric current. With this, the problem of the picture quality change of the panel can be solved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus for an electro luminescence panel having gate lines, data lines crossing with the gate lines, and electro luminescence cells OLED installed at crossing points of the gate lines and the data lines, comprising:

a first TFT connected between a power supply and a data line;

a second TFT connected between the power supply and an electro luminescence cell OLED;

a third TFT connected between the power supply and the first TFT for switching according to a signal on a gate line;

a fourth TFT connected between gate electrodes of the first and second TFTs and the data line for switching according to the signal on the gate line; and a capacitor connected between the gate electrode of the second TFT and the power supply.

2. The driving apparatus of claim 1, wherein the first and second TFTs are TFTs of the same type.

3. The driving apparatus of claim 1, wherein the third and fourth TFTs are TFTs of the same type.

4. The driving apparatus of claim 2, wherein the first and second TFTs are PMOS TFTs.

5. The driving apparatus of claim 3, wherein the third and fourth TFTs are PMOS TFTs.

6. The driving apparatus of claim 2, wherein the first and second TFTs are NMOS TFTs.

7. The driving apparatus of claim 3, wherein the third and fourth TFTs are NMOS TFTs.

8. A driving apparatus of an electro luminescence panel having gate lines, data lines crossing with the gate lines, and electro luminescence cells OLED at crossing points of the gate lines and the data lines, comprising:

a first TFT connected between a power supply and a data line and having a gate electrode connected to the data line;

a second TFT connected between the power supply and an electro luminescence cell OLED;

a third TFT connected between the power supply and a source electrode of the first TFT for switching according to a signal on a gate line;

a fourth TFT connected between the data line and a gate electrode of the second TFT for switching according to the signal on the gate line; and a capacitor connected between the gate electrode of the second TFT and the power supply.

9. The driving apparatus of claim 8, wherein the first and second TFTs are TFTs of the same type.

10. The driving apparatus of claim 8, wherein the third and fourth TFTs are TFTs of the same type.

11. The driving apparatus of claim 9, wherein the first and second TFTs are PMOS TFTs.

12. The driving apparatus of claim 10, wherein the third and fourth TFTs are PMOS TFTs.

13. The driving apparatus of claim 9, wherein the first and second TFTs are NMOS TFTs.

14. The driving apparatus of claim 10, wherein the third and fourth TFTs are NMOS TFTs.

15. A method of driving a driver circuit of an electroluminescence OLED cell of an electroluminescence panel, the electroluminescence panel having gate lines, data lines crossing with the gate lines, and electro luminescence cells OLED at crossing points of the gate lines and the data lines, the driver circuit having a first TFT connected between a power supply and a data line; a second TFT connected between the power supply and an electro luminescence cell OLED; a third TFT connected between the power supply and the first TFT for switching according to a signal on gate line; a fourth TFT connected between gate electrodes of the first and second TFTs and the data line for switching according to the signal on the gate line; and a capacitor connected between the gate electrode of the second TFT and the power supply, the method of driving an electroluminescence cell, comprising:

supplying an on signal on the gate line to the gates of the third and fourth TFTs such that the first TFT is connected to the power supply and is also connected to the data line and the gates of the first and second TFTs are also connected to the data line such a voltage on the data line is transferred to the gate of the second TFT; and subsequently supplying an off signal on the gate line to the gates of the third and fourth TFTs such that a source of the first TFT is disconnected from the power supply and the gate of the second TFT is disconnected from the data line;

whereby a voltage signal on a node of the gate of the second TFT is not discharged to the power supply.

16. The method of claim 15, wherein the first and second TFTs are TFTs of the same type.

17. The method of claim 15, wherein the third and fourth TFTs are TFTs of the same type.

18. The method of claim 16, wherein the first and second TFTs are PMOS TFTs.

19. The method of claim 17, wherein the third and fourth TFTs are PMOS TFTs.

20. The method of claim 16, wherein the first and second TFTs are NMOS TFTs.

21. The method of claim 17, wherein the third and fourth TFTs are NMOS TFTs.

22. The method of claim 19, wherein the on signal is between about −4V to −10V.

23. The method of claim 19, wherein the off signal is between about +4V to +10V.

24. The method of claim 21, wherein the on signal is between about +4V to +10V.

25. The method of claim 21, wherein the off signal is between about −4V to −10V.

26. A method of driving a driver circuit of an electroluminescence OLED cell of an electroluminescence panel, the electroluminescence panel having gate lines, data lines crossing with the gate lines, and electro luminescence cells OLED at crossing points of the gate lines and the data lines, the driver circuit having a first TFT connected between a power supply and a data line and having a gate electrode connected to the data line; a second TFT connected between the power supply and an electro luminescence cell OLED; a third TFT connected between the power supply and a source electrode of the first TFT for switching according to a signal on a gate line; a fourth TFT connected between the data line and a gate electrode of the second TFT for switching according to the signal on the gate line; and a capacitor connected between the gate electrode of the second TFTs and the power supply, the method of driving the driver circuit comprising:

supplying an on signal on the gate line to the gates of the third and fourth TFTs such that source of the first TFT is connected to the power supply and the drain of the first TFT is connected to the data line and the gates of the first and second TFTs are connected to each other such that a voltage on the data line is transferred to the gate of the second TFT; and subsequently supplying an off signal on the gate line to the gates of the third and fourth TFTs such that a source of the first TFT is disconnected from the power supply and the gate of the second TFT is disconnected from the data line;

whereby a voltage signal on a node of the gate of the second TFT is not discharged to the power supply.

27. The method of claim 26, wherein the first and second TFTs are TFTs of the same type.

28. The method of claim 26, wherein the third and fourth TFTs are TFTs of the same type.

29. The method of claim 27, wherein the first and second TFTs are PMOS TFTs.

30. The method of claim 28, wherein the third and fourth TFTs are PMOS TETs.

31. The method of claim 27, wherein the first and second TFTs are NMOS TFTs.

32. The method of claim 28, wherein the third and fourth TFTs are NMOS TFTs.

33. The method of claim 30, wherein the on signal is between about −4V to −10V.

34. (Original) The method of claim 30, wherein the off signal is between about +4V to +10V.

35. The method of claim 32, wherein the on signal is between about +4V to +10V.

36. The method of claim 32, wherein the off signal is between about −4V to −10V.

* * * * *